US005301949A

United States Patent [19]

Aupied

[11] Patent Number: 5,301,949

[45] Date of Patent: Apr. 12, 1994

[54] PUTT STROKE TRAINING APPARATUS AND METHOD FOR USING SAME

[76] Inventor: Steven M. Aupied, 4711 Grammer Ave., Metairie, La. 70001

[21] Appl. No.: 74,615

[22] Filed: Jun. 11, 1993

[51] Int. Cl.[5] ..... A63B 69/36

[52] U.S. Cl. ..... 273/192

[58] Field of Search ..... 273/35 R, 183 R, 183 A, 273/186 R, 186 D, 191 R, 192, 197 R, 197 A

[56] References Cited

U.S. PATENT DOCUMENTS

| | | | |
|---|---|---|---|
| 2,303,736 | 12/1942 | Hall | 273/192 |
| 3,857,570 | 12/1974 | Gutierrez et al. | 273/192 X |
| 3,953,035 | 4/1976 | Beckisk | 273/192 |
| 4,153,255 | 5/1979 | Woodson | 273/192 X |
| 5,125,844 | 6/1992 | Grant et al. | 273/192 X |
| 5,152,534 | 10/1992 | Sindelar | 273/192 |

*Primary Examiner*—William Stoll
*Attorney, Agent, or Firm*—Michael D. Carbo

[57] ABSTRACT

A pocket-sized device for training an individual's putting stroke through muscle development and muscle memorization. A guide plate of the device is a rectangular base having contrasting lines running length-wise and three holes spaced along the center length-wise. The center hole is for a T-shaped center stake to anchor the guide plate to the putting surface. The center stake is placed through the center hole of an upright, substantially U-shaped guide bar that pivots above the guide plate around the downward projecting center spike of the center stake. A flat, annular washer, through which the center spike is inserted, is located between the guide bar and the guide plate to allow ease of motion. The two peripheral holes near each end of the guide plate are for golf tees to help align the device on the line of the chosen putt. The method of putting training and practice includes positioning the device to align the contrasting lines along the line of a chosen putt, anchoring the guide plate by means of tees and the center spike, positioning the upper portion of the "T" of the center stake perpendicular to the line of the putt, repetitively pulling the forward face of a putter against the forward upright arm of the guide bar and then releasing, and repetitively pushing the rear face of a putter against the rearward upright arm of the guide bar and then releasing.

8 Claims, 2 Drawing Sheets

PUTT STROKE TRAINING APPARATUS AND METHOD FOR USING SAME

BACKGROUND OF THE INVENTION

The present invention relates to golf instructional devices and particularly to a pocket-sized putting stroke practice and training device for use by golfers.

Many golfers, with much practice at a driving range, get quite proficient and consistent with their golf swing. However, even with hours of practice time, golfers who do not develop proper putting techniques do not become proficient putters. Putting usually decides the outcome of most golf matches at any level of competition.

Accordingly, it is an object of the invention to enhance the putting stroke through the isolation and development of the muscles used in the motion of the stroke. A further object of the invention is to aid in alignment and visualization of the line of the stroke and how it relates to the line of the putt.

An advantage of this putting stroke practice and training device is its compactness. When disassembled, it is capable of being carried in one's pocket.

Additional objects and advantages of the invention are set forth in part in the description which follows, and in part are obvious from the description or may be learned by practice of the invention. The objects and advantages of the invention may be realized and obtained by means of the articles and apparatus disclosed in the specification and drawings and particularly pointed out in the articles, apparatus, and methods in the appended claims.

SUMMARY OF THE INVENTION

To achieve the objects, and in accordance with the purpose of the invention as broadly described herein, the putt stroke practice and training device for use with putters comprises:

(a) a substantially flat plate having at least one line on an upper surface and having at least one hole for receiving means for anchoring the base plate to a putting surface; and (b) an upright, substantially U-shaped guide bar pivotally connected above the plate.

Preferably, a plurality of parallel stripes are marked on the upper surface of the guide plate. Preferably, an annular washer is located between the guide bar and the guide plate. Preferably, a T-shaped stake is inserted through a central hole in the guide bar, through a hole in the washer, and through a central hole in the guide plate to pivotally connect the guide bar above the guide plate and to anchor the device onto a putting surface. Preferably, two peripheral holes in the guide plate allow for additional anchoring of the guide plate to a putting surface by means of standard tees.

The method for practicing and training putting comprises the steps of:

(a) anchoring the device according to the invention to a putting surface such that the line marked on the guide plate aligns parallel to the line of the chosen putt;

(b) repetitively forcing the forward face of a putter against a forward upright of the guide bar, while the central portion of the guide bar is aligned parallel to the line marked on the guide plate, and releasing; and (c) repetitively forcing the back face of a putter against a rear upright, while the guide bar is aligned with the contrasting parallel lines of the guide plate, and releasing.

Preferably the device according to the invention, having contrasting parallel lines, the T-shaped stake, a central hole in the guide bar, and an annular washer between the guide bar and the guide plate, should be used to practice the method. Preferably, moderate to heavy pressure is used to force the faces of the putter against each upright of the guide bar, while making sure that the guide bar remains on the line of the chosen putt. The pressure should be held for approximately ten seconds before release. The pressure and release procedure should be repeated two or more times. Preferably, the forward pressure and release procedure should be performed, a few practice strokes should then be taken with the putter away from the device, and then the back-stroke pressure and release procedure should be undertaken.

BRIEF DESCRIPTION OF THE DRAWINGS

A greater appreciation of the objects and advantages of the invention may be understood by the below set forth description taken in conjunction with the drawings, wherein.

DETAILED DESCRIPTION OF THE INVENTION

Figure 1:
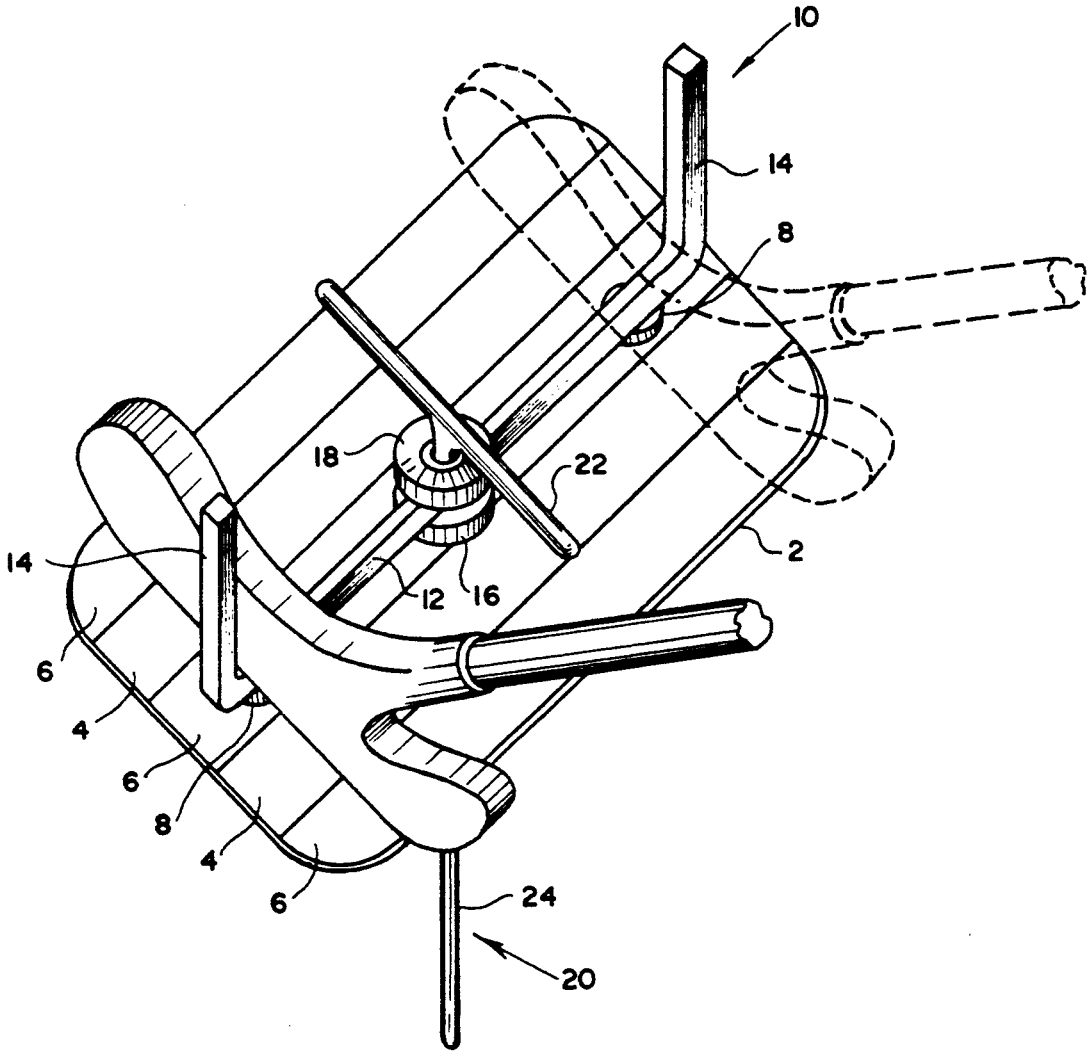
FIG. 1 is a perspective view of an illustrative embodiment of a putt stroke practice and training device according to the invention, also showing a portion of a putter blade against each of the uprights of a guide bar.
Figure 2:
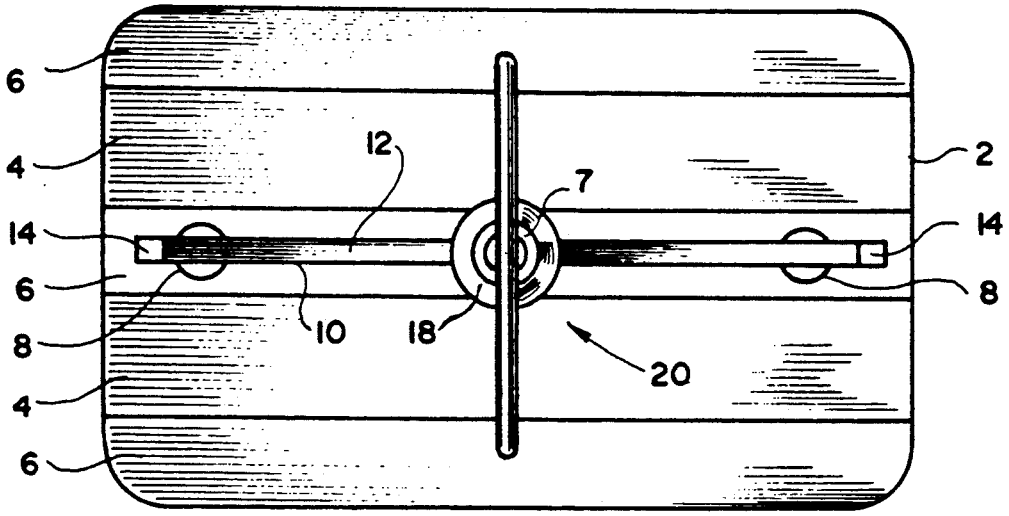
FIG. 2 is a top view of an illustrative embodiment of a putt stroke practice and training device according to the invention, showing a guide bar aligned with a guide plate and showing the top portion of a T-shaped stake aligned perpendicular to the guide bar.
Figure 3:
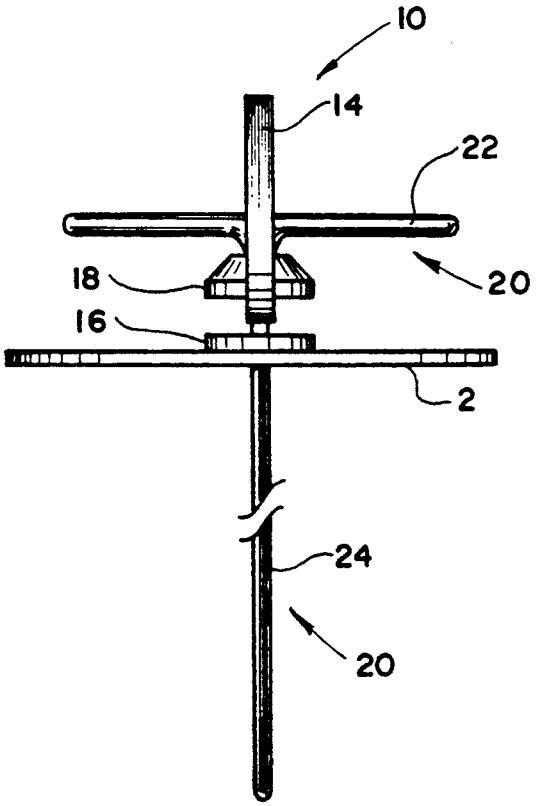
FIG. 3 is a side view of an illustrative embodiment of a putt stroke practice and training device according to the invention, showing a washer supporting the guide bar above the guide plate and a washer supporting the top portion of the T-shaped stake above the guide bar.

FIG. 1 shows a perspective view of a putt stroke practice and training device. The device includes guide plate 2, guide bar 10 and T-shaped stake 20. Guide plate 2 is preferably a thin, substantially rectangular plate having upper and lower flat surfaces, only the upper surface being visible in FIG. 1. Guide plate 2 contains a plurality of direction stripes 4 and 6 marked on its upper surface. Preferably, adjacent stripes are of contrasting color for easy visibility. Guide plate 2 contains a plurality of holes 7 (not apparent in FIG. 1) and 8 spaced along its longitudinal central axis. Central hole 7 is adapted for receiving T-shaped stake 20 for anchoring guide plate 2 to a putting surface. Preferably, a plurality of peripheral hole 8 in guide plate 2 are adapted for receiving standard tees for assisting in anchoring guide plate 2 to a putting surface and for assisting a golfer in aligning guide plate 2 and guide bar 10 along the line of a chosen putt.

Guide bar 10 is a substantially U-shaped bar having central portion 12 and two upright end portions 14. Guide bar 10 contains a central hole (not apparent in the drawings). T-shaped stake 20 is inserted downward through hole 7 in the central portion of guide bar 10 and through hole 7 in the central portion of guide plate 2 to pivotally connect guide bar 10 and guide plate 2. Preferably, annular washer 16 is placed between guide bar 10 and guide plate 2 to support guide bar 10 above guide plate 2. Second annular washer 18 may be placed above guide bar 10, and T-shaped stake 20 may be inserted such that upper portion 22 of T-shaped stake 20 is supported above guide bar 10. Whichever variation is used, guide bar 10 must be able to pivot freely around spike 24 of T-shaped stake 20.

In operation, spike 24 is inserted first through the center hole of guide bar 10, then through the center hole of guide plate 2, and finally into a putting surface. The device is thus assembled and ready for use.

In operation, a golfer should first choose a putt which he or she would like to practice. Using stripes 4 and 6 on guide plate 2, a golfer should align the stripes parallel to the line of a chosen putt. Standard golf tees placed into peripheral holes 8 on guide plate 2 anchor guide plate 2 to a putting surface to maintain the line of a chosen putt.

A golfer should select a putter having parallel front and rear faces. The golfer should position top portion 22 of T-shaped stake 20 perpendicular to the line of a chosen putt. Thus, top portion 22 is preferably perpendicular to guide bar 10. Spike 24 is preferably located where a golf ball would be positioned prior to a stroke.

The face of a putter at the center of the putter blade should be placed against upright 14 that is nearest to a target and moderate to heavy pressure should be used to push the face of the putter toward the target as if following through on a putting stroke, being careful to keep guide bar 10 on the line of the chosen putt. This forward pressure should be maintained for approximately ten seconds and then the pressure should be released. The pressure and release should be repeated preferably twice more. Then, a golfer should back away from the device and hold the putter in a normal stance concentrating on the feel of arm and hand muscles seeming to pull the putter forward toward a target. One or more practice strokes should be taken to maximize and reinforce muscle memory development.

The back face of the putter should then be placed against upright 14 that is farthest away from a target. Using moderate to heavy pressure, the putter should be stroked backward to apply pressure to upright 14, always making sure that guide bar 10 remains on the line of the chosen putt. This rearward pressure should be held for approximately ten seconds and then released. The pressure release procedure should be repeated twice more. The golfer should then back away from the device and hold the putter in an normal stance and concentrate on feeling muscles seemingly pushing the putter away from the target. A few practice strokes should be taken at this time to maximize and reinforce muscle memory development and to relieve the feeling of the putter seeming to pull away from the ball on its own.

The golfer may now address a golf ball and to practice the putting stroke that he has practiced and trained through use of the device according to the invention.

It will be apparent to those skilled in the art that modifications and variations can be made in the device according to the invention and to the method according to the invention. The invention in its broader aspects is not limited to the specific details and illustrative examples shown and described. Accordingly, departure may be made from such details without departing from the spirit or scope of the applicant's general inventive concept.

I claim:

1. A golf putting practice and training device, comprising:

(a) a substantially flat plate having at least one line on an upper surface and having at least one hole for receiving means for anchoring the plate to a putting surface; and (b) an upright, substantially U-shaped bar pivotally connected above the plate.

2. A golf putting practice and training device, comprising:

(a) a substantially flat guide plate having a plurality of parallel stripes on an upper surface and having a plurality of holes for receiving means for anchoring the guide plate to a putting surface; and (b) an upright, substantially U-shaped guide bar pivotally connected to the upper surface of the guide plate.

3. The golf putting practice and training device according to claim 2, further comprising:

(c) means for pivotally connecting the bar above the plate such that the bar remains upright throughout any degree of pivot, and wherein the bar has a central hole for receiving the pivotally connecting means.

4. A golf putting practice and training device, comprising:

(a) a substantially flat plate having a plurality of parallel stripes on an upper surface and having a plurality of holes, including a central hole, for receiving means for anchoring the plate to a putting surface; and (b) an upright, substantially U-shaped bar having a central hole for receiving means for pivotally connecting the bar above the plate and for receiving means for anchoring the plate to a putting surface, wherein the pivotally connecting means and central anchoring means comprise a T-shaped stake having a spike portion and a top portion, the spike portion being inserted through the central holes.

5. The device according to claim 4, further comprising an annular washer between the bar and the plate, the washer for separating the bar above the plate.

6. A golf putting practice and training apparatus, comprising:

(a) a flat, substantially rectangular plate having a plurality of parallel stripes on an upper surface and having a plurality of holes, spaced along a central axis, for receiving means for anchoring the plate to a putting surface;

(b) a generally U-shaped bar having a central portion and two upright arms, each arm being rigidly affixed to an opposite end of the central portion, and having a central hole for receiving pivotally connecting means; and (c) means for pivotally connecting the bar above the plate.

7. The apparatus according to claim 6, wherein the pivotally connecting means comprises a T-shaped stake having a top portion and a spike portion, the spike portion being inserted downward through the central hole of the bar and through a central hole of the plate.

8. A method for practicing and training putting, comprising the steps of:

(a) anchoring a golf putting practice and training device to a putting surface;

(b) aligning a line on an upper surface of a guide plate parallel to a line of a chosen putt;

(c) repetitively forcing a forward face of a putter blade against a forward upright of a guide bar, while keeping a central portion of the guide bar aligned parallel to the line on the guide plate, and releasing; and (d) repetitively forcing a back face of a putter blade against a rear upright of a guide bar, while keeping a central portion of the guide bar aligned parallel to the line on the guide plate, and releasing.

* * * * *